US011081794B2

(12) United States Patent
Reese et al.

(10) Patent No.: US 11,081,794 B2
(45) Date of Patent: Aug. 3, 2021

(54) ANTENNA DEVICE AND METHOD FOR EMITTING ELECTROMAGNETIC WAVES USING THE ANTENNA DEVICE

(71) Applicant: ALCAN Systems GmbH, Darmstadt (DE)

(72) Inventors: Roland Reese, Darmstadt (DE); Matthias Jost, Mainz (DE); Matthias Nickel, Darmstadt (DE); Holger Maune, Darmstadt (DE); Rolf Jacoby, Rosbach (DE)

(73) Assignee: ALCAN Systems GmbH, Darmstadt (DE)

( * ) Notice: Subject to any disclaimer, the term of this patent is extended or adjusted under 35 U.S.C. 154(b) by 0 days.

(21) Appl. No.: 16/333,358

(22) PCT Filed: Sep. 13, 2017

(86) PCT No.: PCT/EP2017/073048
§ 371 (c)(1),
(2) Date: Jun. 3, 2019

(87) PCT Pub. No.: WO2018/050711
PCT Pub. Date: Mar. 22, 2018

(65) Prior Publication Data

US 2019/0312351 A1 Oct. 10, 2019

(30) Foreign Application Priority Data

Sep. 15, 2016 (DE) ..... 10 2016 117 424.6

(51) Int. Cl.
*H01Q 3/44* (2006.01)
*H01Q 13/02* (2006.01)
(Continued)

(52) U.S. Cl.
CPC ..... *H01Q 3/44* (2013.01); *H01Q 3/01* (2013.01); *H01Q 13/02* (2013.01); *H01Q 13/06* (2013.01);
(Continued)

(58) Field of Classification Search
None
See application file for complete search history.

(56) References Cited

U.S. PATENT DOCUMENTS 4,809,011 A * 2/1989 Kunz ..... H01Q 3/44 343/754
5,450,092 A * 9/1995 Das ..... H01Q 3/44 333/99 S (Continued)

FOREIGN PATENT DOCUMENTS

CN 1812194 A 8/2006
CN 104409849 A 3/2015

(Continued)

OTHER PUBLICATIONS

P. Pahlavan, M. S. Sorkherizi, A. Tadjalli and S. R. Hosseini, "Frequency scanning in the uniform leaky-wave antenna based on nonradiative dielectric (NRD) waveguide," 2011 19th Iranian Conference on Electrical Engineering, Tehran, Iran, 2011, pp. 1-5. keywords: {Antenna radiation patterns;Apertures;Dielectrics;Integrated circuits;Leaky wave antennas;Optical waveguides;Leaky-Wave Antenna;Nonradiative Dielectric Wave guide;frequency Scanning},URL: http://ieeexplore.ieee.org/stamp/stamp.jsp?tp=&arnumber=5955505&isnumber=5955412.

(Continued)

*Primary Examiner* — Crystal L Hammond
(74) *Attorney, Agent, or Firm* — Axel Nix

(57) ABSTRACT

An antenna device (1) for emitting electromagnetic waves has a waveguide (2), which in turn has two plates (3) made (Continued)

of an electrically conductive material and arranged parallel to one another, between which a dielectric material is arranged. The antenna device (1) has a feed-in device (4), with which electromagnetic waves can be coupled into the waveguide (2), which then propagate along the waveguide (2) and are emitted at an edge (5) of the waveguide (2) at a distance from the feed-in device (4). According to the invention, using a control device of the antenna device (1), the dielectric material can be influenced in such a way that a first region (9) having a first permittivity and at least one second region (10) having a second permittivity are formed, such that the electromagnetic waves coupled into the waveguide (2) propagate preferably through the first region (9) and are emitted in this preferred propagation direction (11). The waveguide (2) can be in the shape of a circle segment and the feed-in device (4) can feed-in the electromagnetic wave in the centre of the circle. The dielectric material is a fluid having an anisotropic permittivity. The control device can have multiple respective electrodes (12), arranged on the plates (3) of the waveguide (2) and insulated in relation to same, between which an electric field can be generated.

17 Claims, 5 Drawing Sheets

(51) Int. Cl.

| | |
|---|---|
| ***H01Q 13/06*** | (2006.01) |
| ***H01Q 21/06*** | (2006.01) |
| ***H01Q 3/01*** | (2006.01) |
| ***H01Q 19/08*** | (2006.01) |
| ***H01Q 1/36*** | (2006.01) |

(52) U.S. Cl.
CPC ..... *H01Q 19/08* (2013.01); *H01Q 21/06* (2013.01); *H01Q 1/364* (2013.01)

(56) References Cited

U.S. PATENT DOCUMENTS

| | | | | |
|---|---|---|---|---|
| 6,894,652 | B2 | 5/2005 | Rawnick et al. | |
| 8,245,936 | B2 * | 8/2012 | Thuries | G06K 7/10811 235/462.23 |
| 9,366,938 | B1 | 6/2016 | Anderson et al. | |
| 2004/0041741 | A1 | 3/2004 | Hayes | |
| 2004/0160382 | A1 * | 8/2004 | Rawnick | H01Q 15/02 343/909 |
| 2010/0060521 | A1 | 3/2010 | Hayes et al. | |

FOREIGN PATENT DOCUMENTS

| | | | |
|---|---|---|---|
| DE | 60114825 | | 8/2006 |
| DE | 102010036820 | A1 | 2/2012 |
| JP | 2002171119 | A | 6/2002 |

OTHER PUBLICATIONS

S. Strunck, A. Gaebler, O. H. Karabey, M. Jost and R. Jakoby, "Electrically reconfigurable waveguide polarizer using liquid crystal technology for Ka-band applications," 2014 44th European Microwave Conference, Rome, 2014, pp. 508-511.doi: 10.1109/EuMC.2014.6986482http://ieeexplore.ieee.org/stamp/stamp.jsp?tp=&arnumber=6986482&isnumber=6986339.

* cited by examiner

ANTENNA DEVICE AND METHOD FOR EMITTING ELECTROMAGNETIC WAVES USING THE ANTENNA DEVICE

TECHNICAL FIELD

The disclosure relates to an antenna apparatus for emitting electromagnetic waves, comprising a waveguide that comprises two plates arranged in parallel to one another of an electrically conductive material, between which a dielectric material is arranged, and comprising a feed apparatus by means of which electromagnetic waves can be coupled into the waveguide, which waves then propagate along the waveguide and are emitted at an edge of the waveguide that is remote from the feed apparatus.

BACKGROUND

A large number of different antennae are known in practice, by means of which antennae electromagnetic waves can be emitted or received. In this case, the different antenna apparatuses are adapted to different wavelength ranges of the electromagnetic radiation and to the relevant requirements with respect to the desired radiation power, the radiation characteristic, and the fields of use intended in each case. It is possible, for example, to distinguish between linear antennae, which have a linear power distribution in the antenna structure, and planar antennae, in which a cable-conducted wave is emitted over a for example strip-like or circular surface.

In order to reduce transmission losses of the electromagnetic waves from a transmitter to a receiver, it is advantageous to focus the electromagnetic radiation, emitted by the transmitter, towards the receiver, such that the largest possible portion of the radiated power emitted by the transmitter is emitted towards the received and can be received thereby. For this purpose, various antenna apparatuses are known in practice in which the radiation characteristic of the antenna apparatus can be influenced, and the direction of the maximum radiated power or the preferred radiation direction can be changed, and oriented towards a receiver that is remote from the antenna apparatus.

In particular in the case of low frequencies or long wavelengths, antenna apparatuses comprising mechanically displaceable components are used, the displacement of which components allows for the radiation characteristic to be changed and the direction-dependent transmission power to be influenced.

Antenna arrays are also known in which a number of mutually spaced antenna apparatuses each emit electromagnetic waves that are temporally matched to one another, such that the resulting interference of the electromagnetic waves emitted by the individual antenna apparatuses results in a preferred direction in which the largest radiated power is emitted.

For high-frequency electromagnetic waves having a frequency of for example a gigahertz or terahertz, the characteristic dimensions of the antenna apparatuses are often in the range of millimeters and smaller, in order to at least approximately correspond to the wavelengths of the emitted or received electromagnetic radiation. Producing antenna apparatuses with components that can be mechanically displaced relative to one another, which components would be suitable for emitting such high-frequency electromagnetic waves, is very complex and costly. In contrast, the operation of antenna arrays in which each individual antenna apparatus can emit electromagnetic waves having a frequency of a gigahertz or more is susceptible to comparatively high losses in the transmission power owing to the necessary division of the antenna signal over a large number of individual antenna apparatuses and owing to the losses in the respective phase shifters.

It has been found from experience that antenna apparatuses of the type mentioned at the outset, in which the electromagnetic wave propagates along a waveguide formed of two plates arranged in parallel to one another and is emitted from an edge of the waveguide, are also suitable for emitting high-frequency electromagnetic waves having a frequency of one gigahertz or more. However, no such antenna apparatuses are known that would make it possible to influence the radiation characteristic of the emitted electromagnetic waves.

SUMMARY

An object of the present invention is therefore considered to be that of configuring and developing an antenna apparatus of the type mentioned at the outset such that the radiation characteristic, and in particular the direction of a maximum radiated power of the antenna apparatus, can be influenced and specified using simple means and in a manner having the smallest possible losses.

This object is achieved in that the dielectric material can be influenced, by a controller of the antenna apparatus, such that at least one first region having a first permittivity and at least one second region having a second permittivity is formed, such that the electromagnetic waves coupled into the waveguide preferably propagate through the at least one first region and are emitted in said preferred propagation direction. It is not necessary to change the orientation of the two plates arranged in parallel to one another. It has been found that forming a first region between the two plates arranged in parallel to one another, the first permittivity of which region differs from at least one adjacent second region, is already sufficient for influencing and specifying the preferred propagation direction of the electromagnetic waves coupled in via the feed apparatus. The greater the difference between the first permittivity and the second permittivity, and the more distinctly differentiated the first region is from a second adjacent region, the more significantly the preferred propagation direction can be influenced and specified. The permittivity of the dielectric material can also be specified, depending on the material used in each case, in a contactless manner or without mechanical displacement of individual components of the antenna apparatus. Depending on the dielectric material used in each case, and the effect of the controller, very short reaction times can be achieved when adjusting the preferred propagation direction.

The shape of the plates arranged in parallel to one another, and in particular the arrangement of the feed apparatus and the course of the edge of the waveguide that is remote from the feed apparatus can be specified depending on the intended use of the antenna apparatus and for example adjusted to a desired frequency range of the electromagnetic waves and to the desired variation possibilities for the orientation of the preferred propagation direction.

According to a particularly advantageous embodiment of the inventive concept, the waveguide is shaped in the manner of a circular sector and the feed apparatus feeds in the electromagnetic wave in the center of the circle, and the at least one first region and the at least one second region each form smaller circular sectors, within the waveguide, proceeding from the center of the circle. Such a configuration of the antenna apparatus allows for the preferred propagation direction of the electromagnetic waves to be varied over the entire angular range that is covered by the waveguide formed as a circular sector. The first region, which specifies the preferred propagation direction, can be formed by a small circular sector that can be oriented in various directions within the waveguide. If the first region is not directly adjacent to an edge region of the waveguide, the first region, having a higher permittivity, is expediently delimited on both sides by a second region having a lower permittivity, wherein each second region is also formed as a smaller circular sector and the individual circular sectors of the first region and of the two second regions completely cover the circular sector or the angular range of the waveguide.

The waveguide may for example be semi-circular, and extend over an angular range of 180°. The at least one first region, the higher permittivity of which specifies the preferred propagation device, may for example be a circular sector that is adapted to the waveguide and has an opening angle of approximately 10° to 20°. The two second regions each adjoin the associated first region in the peripheral direction, and cover the angular range of the waveguide that is not covered by the first region, i.e., in the example mentioned, an angular range of 170° or 160° in total.

It is likewise possible to specify the waveguide so as to have an angular range that is smaller than 180°, if it is intended for it to be possible to change the preferred propagation direction only within a smaller angular range. It is of course also possible to configure each of the two waveguides as circular plates, and to arrange and configure the feed apparatus in the center of the circle such that the electromagnetic waves are coupled in from the outside, in the region of the center of the circle, and are fed in between the two circular plates, and can subsequently propagate over the entire circular angular range of 360°. It is then possible, by means of the configuration and orientation of the at least one first region, to specify a preferred propagation direction as desired, within the complete circular angle of 360°.

The at least one first region and the at least one second region can extend in the radial direction, from the center of the circle as far as the edge region. It is also possible for the first region to extend in the radial direction not as far as the edge region of the waveguide, but instead only over a portion. In this case, the radius of the first region may be more than 50%, preferably more than 75%, of the radius of the edge region.

If it is intended that it should be possible to change or switch the preferred propagation direction only between two or three or more individual directions, according to an embodiment of the inventive concept, it is advantageous for the waveguide to comprise an outer peripheral edge that extends along a plurality of mutually adjoining chords, and for the feed apparatus to feed the electromagnetic wave into the center of the circle, and for edges of the at least one first region and of the at least one second region that proceed from the center of the circle to each extend, in a circumferential circle, through the points of intersection of the chord assigned to the first and second region, respectively. The circumferential circle that delimits the at least one first region and the at least one second region in the radial direction may correspond to the outer peripheral edge of the waveguide, but may also have a smaller radius. The individual chord portions then each extend perpendicularly to the preferred propagation direction of the emitted electromagnetic waves that is specified in this angular range, around the feed apparatus. The first region that is associated with a chord and within which the electromagnetic waves are preferably intended to propagate is substantially triangular. The process of influencing the dielectric material in the individual angular ranges, delimited by chords, can be implemented in a structurally simple and cost-effective manner.

According to an optional variant it is possible for the dielectric material to be able to be influenced, by the controller of the antenna apparatus, such that two first regions having a first permittivity and at least one second region therebetween, having a second permittivity, are formed. The two first regions are preferably delimited, on both sides, by a second region in each case. The two first regions make it possible for the antenna apparatus to emit electromagnetic waves in two different preferred propagation directions simultaneously. Two main emission directions are formed, in which the main portion of the electromagnetic waves that are coupled in, or of the electromagnetic emitted emission power that is coupled in, is emitted.

According to one embodiment of the inventive concept, it is provided, that the dielectric material is a dielectric solid, the shape of which corresponds to the first region, and the orientation of which relative to the feed apparatus can be changed. The dielectric solid may for example be a circular sector or a triangle of a dielectric material having a high permittivity in the intended wavelength range of the emitted electromagnetic waves. A dielectric material that is expedient for a plurality of uses is for example a polystyrene plastics material having a permittivity of $\varepsilon_r$=2.53 at 50 GHz. The dielectric solid may for example be displaced and oriented in the preferred propagation direction in each case, by means of appropriate forced guidance, using the controller of the antenna apparatus. It is also possible, for example by means of embedding magnetic materials, to specify the orientation of the dielectric material by means of variable magnetic fields that are applied from the outside. In the case of antenna apparatuses of sufficiently large dimensions, a mechanical operative connection of the controller with the dielectric solid may be provided, and the dielectric solid may be displaced for example using Bowden cables or guide rods, or via a transmission mechanism.

The dielectric material may also be a controllable dielectric solid such as barium strontium titanate.

According to a preferred embodiment of the inventive concept, it is provided that the dielectric material is a fluid having an anisotropic permittivity. A fluid that is suitable for this purpose is for example a liquid crystal material, in which the individual rod-shaped molecules have permittivities that differ significantly from one another, along a longitudinal axis and transversely thereto. The liquid crystal material can be influenced for example by applying an electric field, such that different permittivities can be specified, by means of the waveguide, for individual regions of the liquid crystal material, in the propagation direction of the electromagnetic waves. Various liquid crystal materials are commercially and cheaply available, owing to the frequent use of materials of this kind in other product fields.

Controlling the liquid crystal material and/or influencing the orientation of individual liquid crystal molecules by means of externally generated electric fields has already been extensively studied, and is known from practice in a wide range of variants and embodiments. It is thus possible, for example, for one electrode structure, in each case, to be arranged on the plates so as to be electrically isolated, and for the desired voltage distribution to be applied thereto by the controller, in order to influence the orientation of the individual liquid crystal molecules in the liquid crystal material located in the intermediate space between the two plates, and to thereby specify the permittivity in the propagation direction of the electromagnetic waves. In this case, a liquid crystal material is expediently used that exhibits a particularly high degree of anisotropy in the permittivity.

The controller in each case may comprise a plurality of electrodes that are arranged on the plates of the waveguide and are isolated therefrom, or separately controllable electrode segments, between which an electric field can be generated, as a result of which the permittivity of the fluid arranged between the plates can be influenced, and a first region having a first permittivity and at least one second region having a second permittivity can be specified. The larger the number of electrodes or individually controllable segments of the electrodes on the plates, the more various the possibilities for influencing and specifying the preferred propagation direction of the emitted electromagnetic waves.

According to an advantageous embodiment of the inventive concept, it is provided that each electrode is designed in the form of a strip or a narrow circular sector, and extends from the feed apparatus to a remote edge of the associated plate of the waveguide. A sufficient number of electrodes designed in this manner makes it possible to apply an electric field to individual angular ranges of the waveguide, in order to form, in the dielectric fluid located between the plates, a first region having a high permittivity and second regions having a low permittivity, which second regions are adjacent to said first region on at least one side, or optionally on both sides.

The electrodes do not necessarily have to be arranged directly on the plates. It is also conceivable that an electrical field is generated that penetrates the waveguide from the outside. It is furthermore also possible for the electrical field to be generated by electrodes that are arranged between the plates or outside the plates of the waveguide, between edge regions of the waveguide that extend so as to be spaced from one another.

It has been found that it is particularly advantageous, according to an optional embodiment, for the electrodes to have a regularly or irregularly curved course along the edges thereof, and/or to have a regularly or irregularly three-dimensionally structured surface. The edges of the electrodes may for example have an undulating or crenelated course. The individual waves or crenels may be formed regularly or irregularly, or successively. In particular, the surfaces of the electrodes that face the plates may have a three-dimensionally structured surface comprising either regularly or irregularly arranged or designed structures. The non-straight-line course of the edges, and the not completely planar design of the surfaces of the electrodes reduces an undesired influence of the electromagnetic fields for the wave emission, which may if applicable be generated by the formation of an electromagnetic field between the electrodes, which electromagnetic field is necessary and generated for the formation of the first region, having a first permittivity, that is located between the electrodes.

It is furthermore also possible to influence the dielectric material by means of an externally applied magnetic field that penetrates the waveguide. Depending on the properties of the dielectric material used, it is also possible to use other modes of action in order to bring about a specified orientation of individual molecules and a change in the permittivity, for example by means of suitable specification of a pressure or a temperature.

In order to be able to appropriately adjust the wave impedance when the electromagnetic waves are released from the waveguide into free space, and to reduce undesired reflections at the edge of the waveguide, it is possible for the two plates to be mutually spaced, in an edge region remote from the feed apparatus, by a distance that increases as the distance from the feed apparatus increases. For this purpose, the edge regions of the two plates can each be formed so as to be obliquely angled towards the outside, or so as to sharply taper to a point towards the outside. The edge region of the waveguide that is designed in this way functions in the manner of a horn radiator and allows for an additional improvement in the radiated power in the preferred propagation direction.

The edge regions of the two plates can also each be arranged, relative to the waveguide plane of the parallel regions of the waveguide, at a specified angle, such that the electromagnetic waves are emitted at an angle relative to the waveguide plane. Such a configuration of the edge regions may be advantageous when the antenna apparatus is arranged, as intended, at a boundary surface, for example on a wall or on a ceiling.

It is likewise possible, and can be achieved with little constructive effort in particular when the dimensions of the waveguide are sufficiently large, for the orientation and/or shape of the edge regions of the two plates of the waveguide to be able to be changed during operation, in order that the edge regions can influence the preferred propagation direction and change said propagation direction in a directional plane that is perpendicular to the direction plane specified by the parallel plates in which the preferred propagation direction can be influenced and specified by the dielectric material.

The disclosure also relates to a method for emitting electromagnetic waves using an antenna apparatus having the features described above. It may be provided that at least one first region having a first permittivity and at least one second region having a second permittivity is formed using the controller of the antenna apparatus, such that the electromagnetic waves coupled into the waveguide preferably propagate through the at least one first region and are emitted in said preferred propagation direction.

It is possible for the at least one first region to be formed as a circular sector or a triangle and for the orientation of the circular sector or triangle relative to the feed apparatus to be adjusted depending on a specified emission direction, during the operation of the antenna apparatus. It is also possible for the first region to be formed as a circular sector or a triangle and for the angular range covered by the circular sector or triangle to be adjusted depending on a specified directional focusing. It is thus possible, for example, depending on the intended use in each case, for a comparatively wide emission of the electromagnetic waves that extends over a large angular range to be specified, in the desired propagation direction, by a wide first region, or for an emission of the electromagnetic waves that is focused on a very narrow angular range to be specified by specifying a correspondingly narrow first region. However, it has been found that the directional focusing worsens again when too narrow a first region is specified, and therefore, an advantageous width of the first region can be determined and specified, on the basis of the wavelength of the electromagnetic radiation and the design of the waveguide and of the dielectric material, by means of which width the best possible directional focusing of the preferred emission direction can be achieved.

It is also possible for both the width, or the angular range coverage, of the first region, and the orientation thereof, to be changed simultaneously during the operation of the antenna apparatus.

The antenna apparatus may also comprise a plurality of waveguides that are stacked on top of one another and into which electromagnetic waves can be coupled via a common feed apparatus or via a plurality of separate feed apparatuses that are each assigned to a waveguide. A suitable combination of a plurality of waveguides makes it possible to significantly increase the total electromagnetic radiated power emitted by the antenna apparatus in a preferred emission direction.

It is of course also possible to arrange a plurality of antenna apparatuses so as to be spaced to one another and to operate said apparatuses in a synchronized manner, in order to increase the total electromagnetic radiated power that is emitted in the preferred propagation direction. In this case, the plurality of antenna apparatuses may be arranged to be mutually spaced to one another in a matrix-like manner, or may also be arranged to be stacked on top of one another for example. In the case of a plurality of antenna apparatuses that are stacked on top of one another, it is possible for only the outer plates of the stacked waveguide to comprise an edge region, forming one single horn radiator for all the waveguides.

According to an optional embodiment of the inventive concept, it is possible for two or more first regions to be formed and oriented simultaneously, in each antenna apparatus, such that the electromagnetic waves that are fed in propagate in two or more preferred propagation directions simultaneously.

Some exemplary embodiments of the inventive concept will be explained in greater detail in the following, which exemplary embodiments are shown by way of example in the drawings.

DETAILED DESCRIPTION

Figure 1:
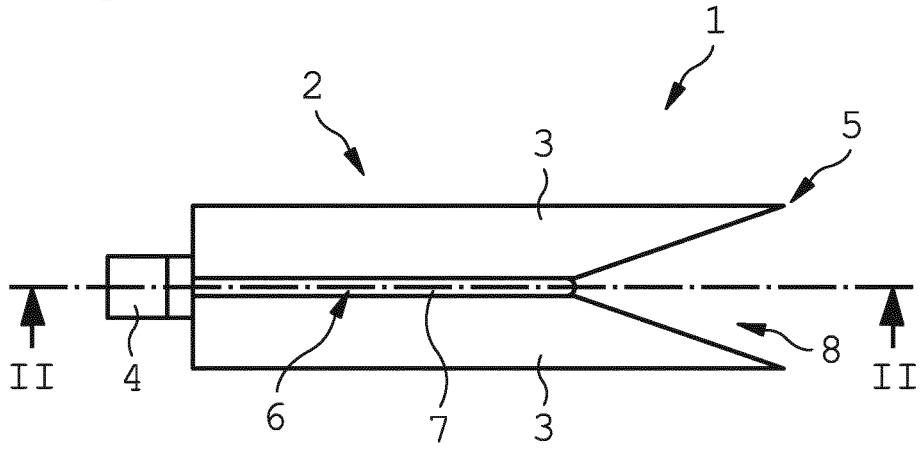
FIG. 1 is a side view of an antenna apparatus.
Figure 2:
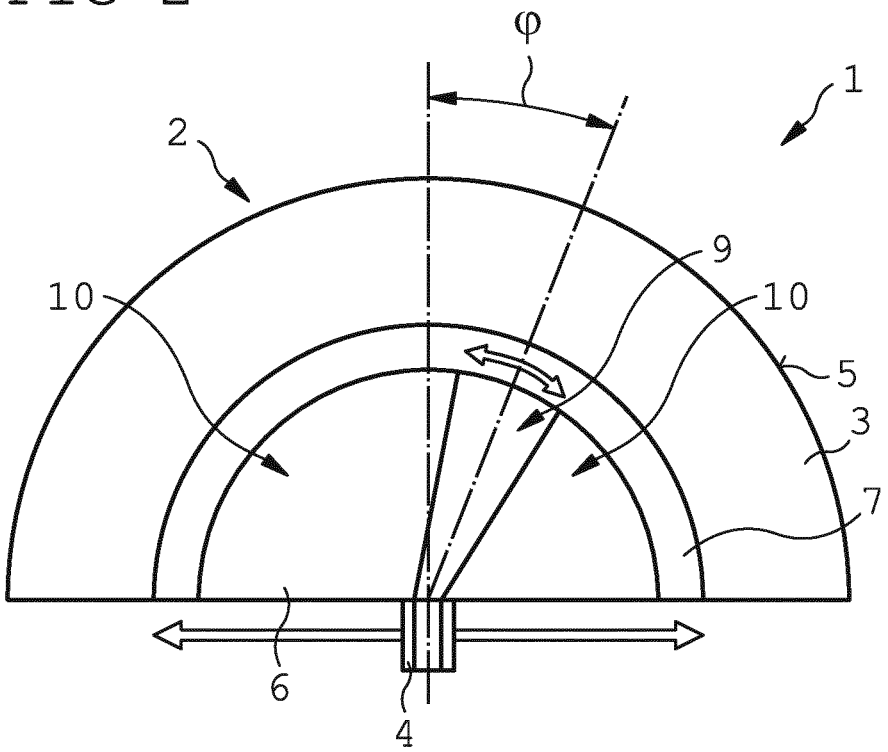
FIG. 2 is a sectional view through the antenna apparatus shown in FIG. 1, along the line II-II in FIG. 1.

FIGS. 1 and 2 are a schematic side view and a schematic cross section, respectively, of an embodiment, by way of example, of an antenna apparatus 1. The antenna apparatus 1 comprises a waveguide 2 that comprises two plates 3 arranged in parallel to one another and of a suitable electrically conductive material. The two plates 3 are each formed semi-circular. A feed apparatus 4 is arranged in the region of the center of the circle of the semi-circular plates 3, by means of which feed apparatus electromagnetic waves can be coupled into the waveguide 2 in order to then propagate along the waveguide 2, until the electromagnetic waves are emitted into free space, at an edge 5 of the waveguide 2 that is spaced from the feed apparatus 4.

A fluid of a suitable liquid crystal material is arranged in an inner semi-circular intermediate space 6. The fluid is confined, towards the edge 5, by a semi-circular sealing ring 7 and is enclosed in the intermediate space 6. From the sealing ring 7, the two plates 3 of the waveguide 2 taper continuously towards the edge 5 and form a semi-circular aperture slot 8, the slot width of which increases continuously as the distance from the center of the circle increases. The shape of the plates 3 in the region of the aperture slot 8 at the edge 5 corresponds to the shape of a horn radiator, and is intended to facilitate the transition of the electromagnetic wave from the waveguide 2 into free space.

A controller (not shown in FIGS. 1 and 2) of the antenna apparatus 1 influences the fluid in the intermediate space 6 and creates a first region 9 having a first, high permittivity, which is delimited on both sides by a second region 10 in each case, in which second region the fluid has a second permittivity that is lower than the first permittivity. The electromagnetic waves that are coupled in from the feed apparatus 4 preferably propagate through the first region 9, having the higher permittivity, such that the electromagnetic waves preferably propagate and are emitted in a propagation direction that is specified by the orientation of the first region 9.

The first region 9 and the two second regions 10 are each formed as a circular sector and together cover the associated semi-circular circular shape of the waveguide 2.

Figure 3:
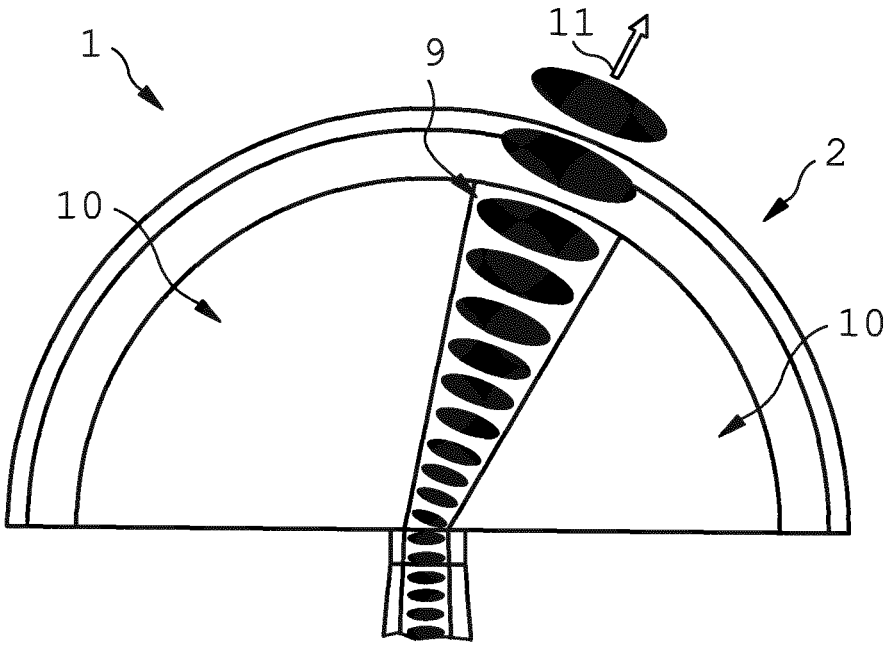
FIG. 3 is a schematic illustration of the propagation of electromagnetic waves that are coupled into a waveguide of the antenna apparatus via the feed apparatus, and propagate, in the waveguide, along a first region having a first permittivity.

FIG. 3 shows, by way of example, a simulated distribution of the electric field of the electromagnetic waves that are coupled into the waveguide 2. It can be clearly seen that the electromagnetic waves that are coupled in move almost exclusively through the first region 9, having the higher permittivity, and propagate and are emitted by the antenna apparatus 1 in a propagation direction 11 that is specified by the arrangement of the first region 9. Only a small portion of the electromagnetic waves propagates in the second region 10 and leaves the antenna apparatus 1 in a direction that differs from the preferred propagation direction 11.

Figure 4:
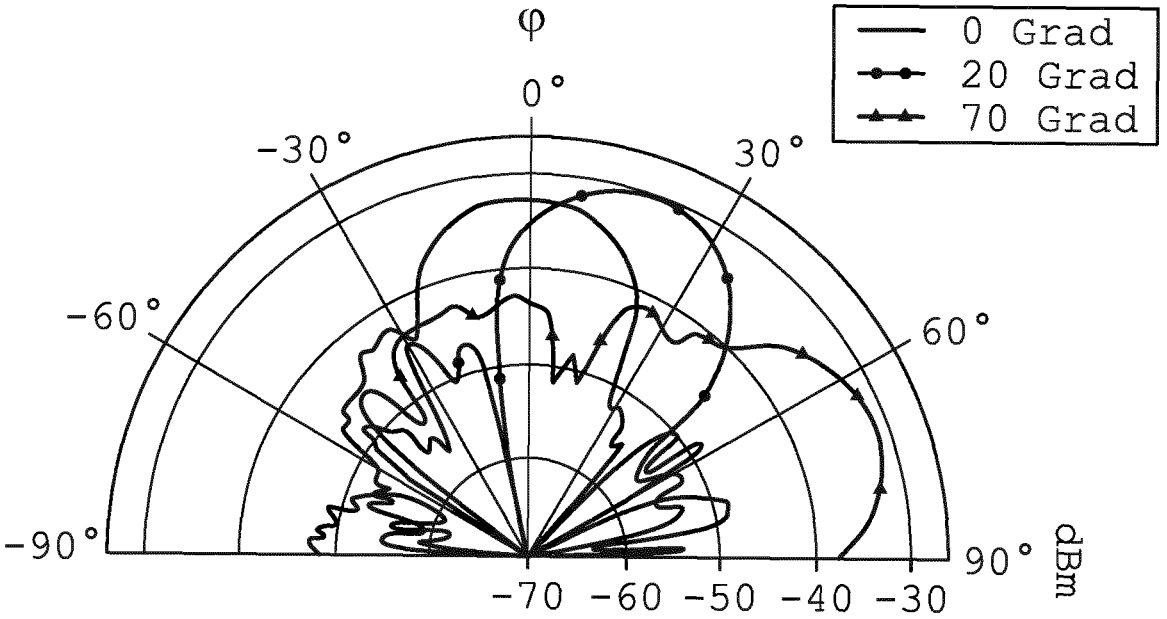
FIG. 4 is a graphical depiction of radiation characteristics of emitted electromagnetic waves that were generated using a prototype of the antenna apparatus shown in FIGS. 1 and 2, emitted in various preferred propagation directions, and measured.

FIG. 4 shows radiation characteristics, generated and measured using a prototype of the antenna apparatus 1 shown in FIGS. 1 and 2, for the emission of the electromagnetic waves, wherein three different preferred propagation directions have been specified. It can clearly be seen that the maximum radiated power is in each case emitted in the specified propagation direction $\varphi$, specified so as to be 0°, 20° and 70° in the case of the measurements shown in FIG. 4. The reference system for the angle $\varphi$ of the specified propagation direction is shown in FIG. 1.

Figure 5:
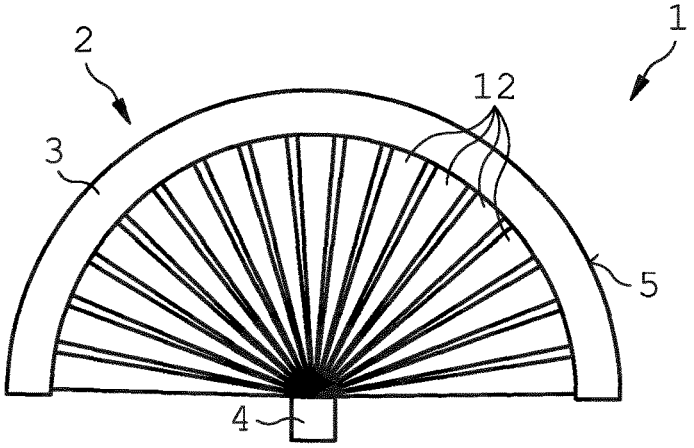
FIG. 5 is a schematic plan view of an antenna apparatus comprising an electrode assembly that is attached to a plate of the waveguide and is intended for influencing a dielectric fluid arranged between the two plates of the waveguide.

FIG. 5 schematically shows an arrangement of a number of electrodes 12 on a plate 3 of the waveguide 2. The individual electrodes 12 are in the shape of a circular sector in each case, and are arranged in a fan-like manner over the entire 180° angular range of the waveguide 2. A comparable electrode configuration is also arranged on the opposite plate 3. Using the controller (not shown), it is then possible to generate an electrical potential difference or an electric field between mutually associated electrodes 12 that are arranged on the two plates 3, which electrical potential difference or electric field acts on the dielectric fluid in the intermediate space between the two plates 3 in order, for example, to change and specify an orientation of individual liquid crystal molecules of the dielectric fluid and, associated therewith, the permittivity, in the intermediate space 6 covered by the electrodes 12.

The electrodes 12 which are arranged side-by-side and to which a consistent electrical potential is applied, form the first region 9 which specifies the preferred propagation direction. The number of electrodes 12 which are assigned to the first region and to which a voltage is applied accordingly can specify a width of the first region 9 or an angular range that is covered by the first region 9. The more electrodes 12 are assigned to the first region 9 and to which voltage is applied accordingly, the wider the first region 9 is. It is possible, in principle, that for example 180 or 360 electrodes 12 may be arranged in the 180° angular range of the semi-circular waveguide 2, such that a correspondingly precise specification of the first region 9, and thus a precise adjustable and specifiable preferred propagation direction can be specified.

Figure 6:
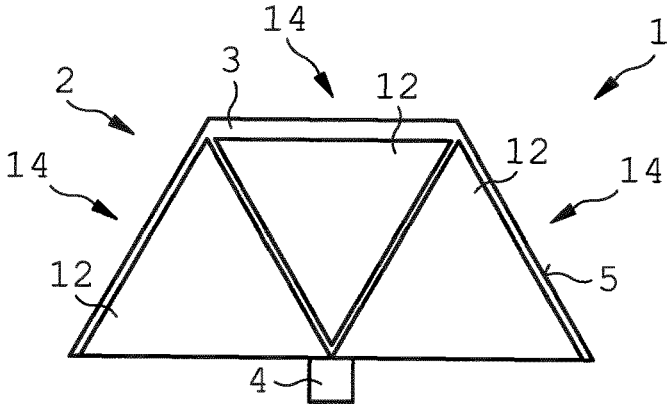
FIG. 6 is a schematic view of a differently designed antenna apparatus.

FIG. 6 shows an embodiment, by way of example, for an antenna apparatus 1, by means of which only three different preferred propagation directions can be specified. The edge 5 of the waveguide 2 is formed by three chords that are adjacent to one another and also cover an angular range of 180°. The intermediate space 6 between the two plates 3 is divided into three regions 14 by three triangular electrodes 12. Each of said three regions 14 can be configured as the first region 9 for the preferred propagation direction or as the second region 10, by corresponding control of the electrodes 12 using the controller, in order for it to be possible to electively specify the preferred propagation direction for the antenna apparatus 1.

Figure 7:
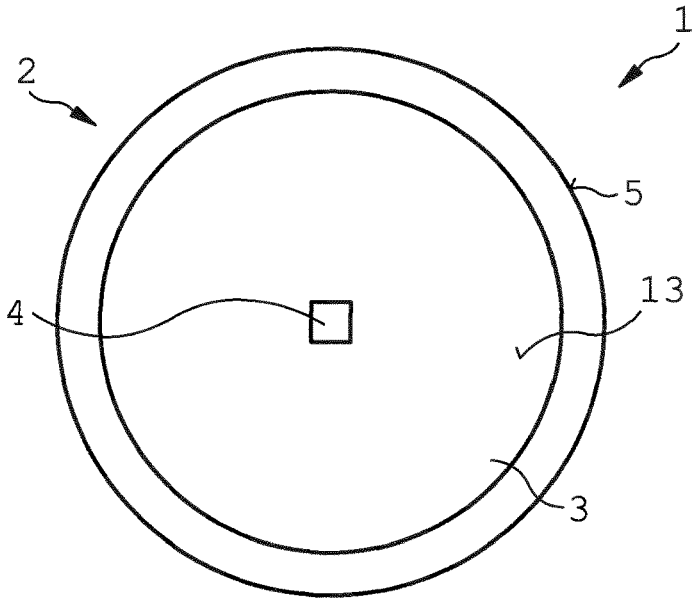
FIG. 7 is a schematic view of an antenna apparatus that is again designed differently.

FIG. 7 also shows an antenna apparatus 1, merely schematically and by way of example, comprising a circular waveguide 2. The electromagnetic waves are coupled in via a feed apparatus 4 arranged in the center of the circle, which apparatus is arranged on an outer face 13 of a plate 3 of the waveguide 2 and couples electromagnetic waves from the outside into the intermediate space 6 between the two plates 3. The electromagnetic waves that are coupled into the center of the circle can propagate in any desired direction, in the 360° angular range covered by the waveguide 2. The preferred propagation direction for the electromagnetic waves emitted by said antenna apparatus 1 can be specified by means of a suitable electrode configuration.

Figure 8:
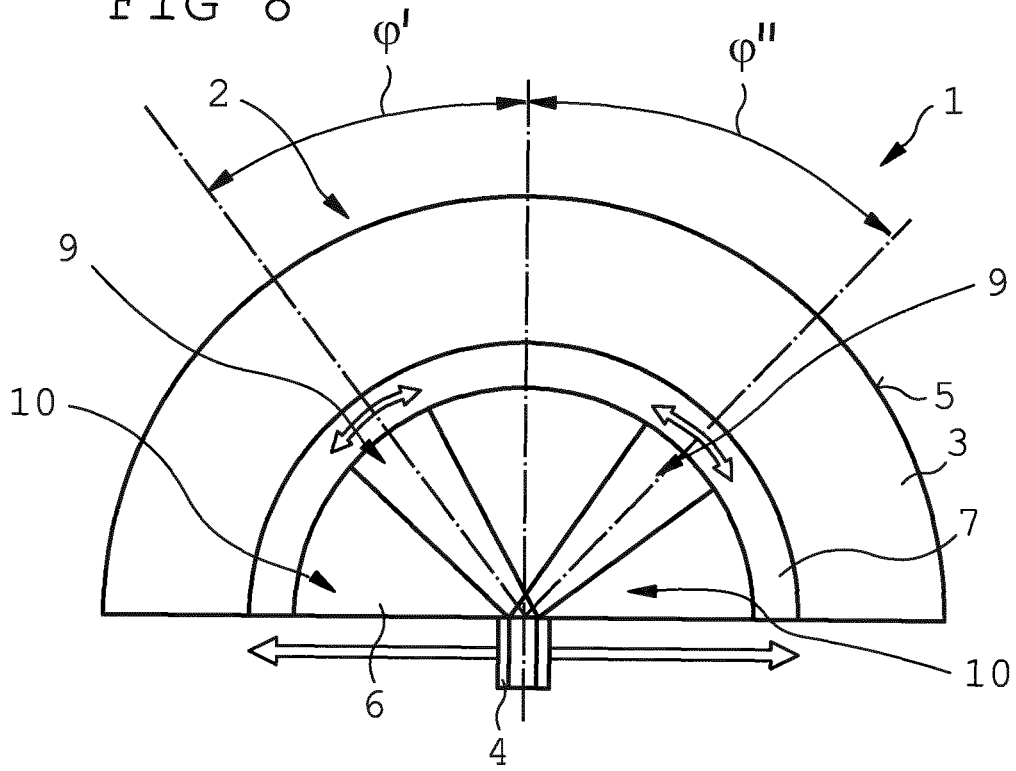
FIG. 8 is a schematic view according to FIG. 2, wherein the electromagnetic waves propagate, in the waveguide in two different preferred propagation directions, along two first regions having a first permittivity.
Figure 9:
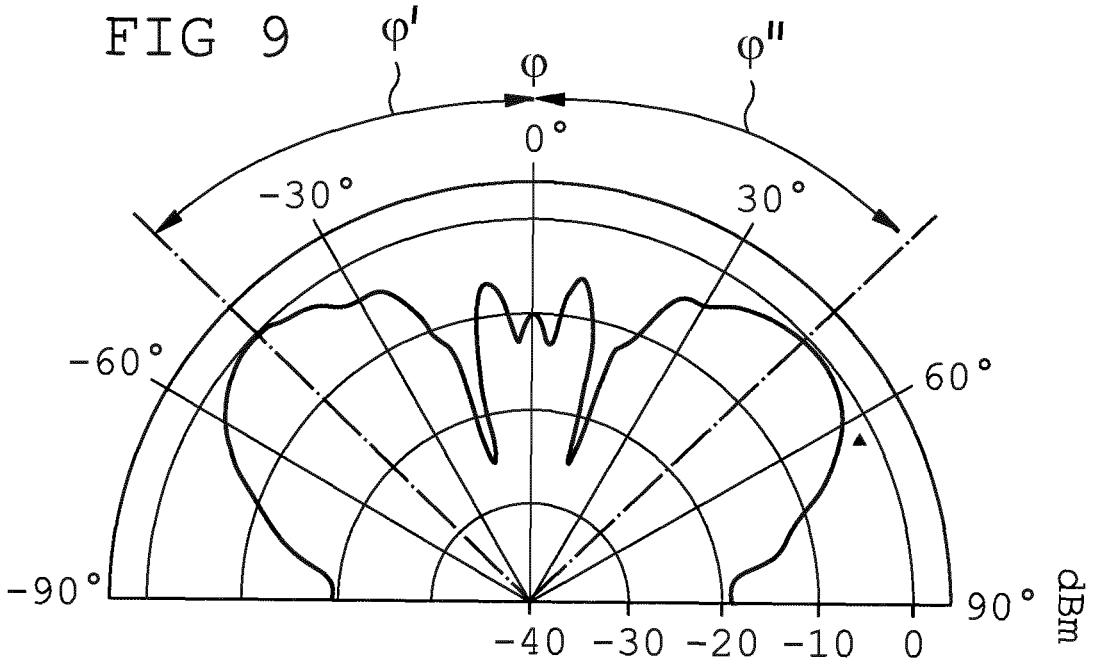
FIG. 9 is a graphical depiction of a radiation characteristic of the electromagnetic waves emitted in two preferred propagation directions by means of an antenna apparatus shown in FIG. 8.

FIGS. 8 and 9 are schematic views of an antenna apparatus 1 that is designed differently from FIG. 1 to 7, and the radiation characteristic thereof. Two first regions 9 are formed between the two plates 3 of a semi-circular waveguide 2, which regions are oriented at an anticlockwise angle φ' or at a clockwise angle φ" relative to a propagation direction that is directed centrally upwards in FIGS. 8 and 9. This generates an emission of electromagnetic waves having a radiation characteristic that is shown schematically in FIG. 9 and that clearly comprises two main emission directions.

Figure 10:
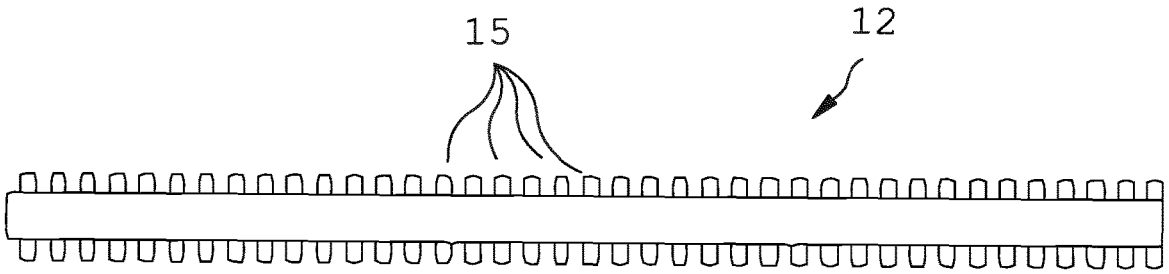
FIG. 10 is a schematic side view of an electrode comprising a crenelated-running edge on both sides.
Figure 11:
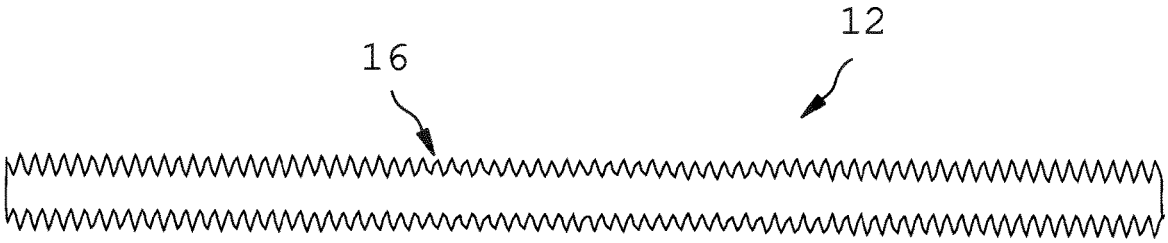
FIG. 11 is a schematic side view of an electrode comprising an irregularly undulating peripheral edge on both sides.

FIGS. 10 and 11 are schematic views of two different embodiments, by way of example, for an electrode 12. The electrode 12 shown in a side view in FIG. 10 comprises a number of crenelated projections 15 along the edges thereof, on an end face that faces the observer, such that both edges have a crenelated curved course. The individual crenelated projections 15 are uniform and are arranged in a regular manner. The electrode 12 which is also shown in FIG. 11 in a side view comparable to FIG. 10 has an undulating curved course 16 along the edges thereof, on the end face that faces the observer. The undulating curved course comprises individual undulating shapes which are non-uniform but are arranged in a substantially regular manner along the edges. The crenelated projections 15 and the individual undulating shapes could also be irregularly distributed along the edges. It is also possible for an outer face of the electrodes 12 that is arranged at the top and bottom in the end views in FIGS. 10 and 11 to have a correspondingly three-dimensionally structured surface. The non-straight edges, and optionally the three-dimensionally structured surfaces of the electrodes 12 can reduce or even entirely prevent an interfering influence of the electromagnetic field generated between the electrodes 12, by means of which field the first regions 9 and second regions 10 are created and specified, on the emission of the electromagnetic waves that are fed into the antenna apparatus 1 and emitted from the antenna apparatus 1.

An antenna apparatus 1 provides significant advantages when used for various communications services and communications devices, and for example also when used in sensor technology. The antenna apparatus 1 allows for electrically controllable beam scanning without using an array antenna, having the disadvantages associated therewith. The losses, generally arising in the case of conventional array antennas, in a distribution network and in the individual phase shifters, can be prevented. The antenna apparatus 1 can be produced by means of comparatively simple manufacturing technologies, and is suitable in particular for emitting radio-frequency electromagnetic waves having a frequency of for example several gigahertz and more.

The invention claimed is:

1. An antenna apparatus (1) for emitting electromagnetic waves, comprising:

a waveguide (2) that comprises two plates (3) arranged in parallel to one another of an electrically conductive material, between which a dielectric material is arranged; and a feed apparatus (4) by means of which electromagnetic waves can be coupled into the waveguide (2), which waves then propagate along the waveguide (2) and are emitted at an edge (5) of the waveguide (2) that is remote from the feed apparatus (4), wherein the dielectric material can be influenced, by a controller of the antenna apparatus (1), such that at least one first region (9) having a first permittivity and at least one second region (10) having a second permittivity is formed, such that the electromagnetic waves coupled into the waveguide (2) preferably propagate through the at least one first region (9) and are emitted in said preferred propagation direction (11).

2. The antenna apparatus (1) according to claim 1, wherein the waveguide (2) is shaped in the manner of a circular sector and the feed apparatus (4) feeds in the electromagnetic wave in the center of the circle, and wherein the at least one first region (9) and the at least one second region (10) each form smaller circular sectors, within the waveguide, proceeding (2) from the center of the circle.

3. The antenna apparatus (1) according to claim 1, wherein the waveguide (2) comprises an outer peripheral edge that extends along a plurality of mutually adjoining chords, and the feed apparatus (4) feeds the electromagnetic wave into the center of the circle, and wherein edges of the at least one first region (9) and of the at least one second region (10) that proceed from the center of the circle each extend, in a circumferential circle, through the points of intersection of a chord assigned to the first and second region (9, 10), respectively.

4. The antenna apparatus (1) according to claim 1, wherein the dielectric material can be influenced, by the controller of the antenna apparatus (1), such that two first regions (9) having a first permittivity and at least one second region (10) therebetween, having a second permittivity, are formed.

5. The antenna apparatus (1) according to claim 4, wherein the dielectric material of the at least one first region (9) is a dielectric solid, the shape of which corresponds to the first region (9), and the orientation of which relative to the feed apparatus (4) can be changed.

6. The antenna apparatus (1) according to claim 5, wherein the dielectric material comprises a dielectric solid, in particular barium strontium titanate.

7. The antenna apparatus (1) according to claim 1, wherein the dielectric material is a fluid having an anisotropic permittivity.

8. The antenna apparatus (1) according to claim 7, wherein the controller in each case comprises a plurality of electrodes (12) that are arranged on the plates (3) of the waveguide (2) and are isolated therefrom, between which an electric field can be generated, as a result of which the permittivity of the fluid arranged between the plates (3) can be influenced, and a first region (9) having a first permittivity and at least one second region (10) having a second permittivity can be specified.

9. The antenna apparatus (1) according to claim 8, wherein each electrode (12) is designed in the form of a strip or a narrow circular sector, and extends from the feed apparatus (4) to a remote edge of the associated plate (3) of the waveguide (2).

10. The antenna apparatus (1) according to claim 2, wherein each electrode (12) comprises a regularly or irregularly curved course along the edges thereof, and/or has a regularly or irregularly three-dimensionally structured surface.

11. The antenna apparatus (1) according to claim 1, wherein the two plates (3) are mutually spaced, in an edge region (5) remote from the feed apparatus (4), by a distance that increases as the distance from the feed apparatus (4) increases.

12. The antenna apparatus (1) according to claim 1, wherein edge regions (5) of the two plates (3) are each arranged, relative to antenna apparatus waveguide plane of the parallel regions of the plates (3) of the waveguide (2), at a specified angle, such that the electromagnetic waves are emitted at angle of between 0° and 90° relative to the waveguide plane.

13. The antenna apparatus (1) according to claim 1, wherein the antenna apparatus (1) comprises a plurality of waveguides (2) that are stacked on top of one another and into which electromagnetic waves can be coupled via a common feed apparatus (4) or via a plurality of separate feed apparatuses (4) that are each assigned to a waveguide (2).

14. A method for emitting electromagnetic waves using an antenna apparatus (1) according to claim 1, wherein at least one first region (9) having a first permittivity and at least one second region (10) having a second permittivity is formed using the controller, such that the electromagnetic waves coupled into the waveguide (2) preferably propagate through the at least one first region (9) and are emitted in said preferred propagation direction (11).

15. The method according to claim 14, wherein the at least one first region (9) is formed as a circular sector or a triangle and the orientation of the circular sector or triangle relative to the feed apparatus (4) is adjusted depending on a specified emission direction.

16. The method according to claim 14, wherein the at least one first region (9) is formed as a circular sector or a triangle and the angular range covered by the circular sector or triangle is adjusted depending on a specified directional focusing.

17. The method according to claim 14, wherein a plurality of antenna apparatuses are arranged so as to be mutually spaced and are operated in a synchronized manner.

* * * * *